US010294054B2

(12) United States Patent
Gnan

(10) Patent No.: US 10,294,054 B2
(45) Date of Patent: May 21, 2019

(54) SPLICE ARRANGEMENT

(71) Applicant: BHS Corrugated Maschinen-und Anlagenbau GmbH, Weiherhammer (DE)

(72) Inventor: Alfons Gnan, Vilseck (DE)

(73) Assignee: BHS Corrugated Maschinen-und Anlagenbau GmbH, Weiherhammer (DE)

( * ) Notice: Subject to any disclaimer, the term of this patent is extended or adjusted under 35 U.S.C. 154(b) by 91 days.

(21) Appl. No.: 15/466,190

(22) Filed: Mar. 22, 2017

(65) Prior Publication Data

US 2017/0275116 A1 Sep. 28, 2017

(30) Foreign Application Priority Data

Mar. 24, 2016 (DE) ..... 10 2016 205 059

(51) Int. Cl.
*B65H 19/20* (2006.01)
*B65H 19/10* (2006.01)
*B65H 19/18* (2006.01)

(52) U.S. Cl.
CPC ..... *B65H 19/102* (2013.01); *B65H 19/1852* (2013.01); *B65H 19/1873* (2013.01); *B65H 19/20* (2013.01); *B65H 2301/4631* (2013.01); *B65H 2408/2211* (2013.01); *B65H 2701/1762* (2013.01)

(58) Field of Classification Search
CPC .. B65H 19/20; B65H 19/102; B65H 19/1852; B65H 19/1873; B65H 2408/2211
See application file for complete search history.

(56) References Cited

U.S. PATENT DOCUMENTS 3,841,944 A * 10/1974 Harris, Jr. ..... B65H 19/1852 156/159
4,481,053 A * 11/1984 Tokuno ..... B65H 19/1852 156/157
5,171,396 A 12/1992 Rank et al.
6,786,264 B1 * 9/2004 Torres Martinez ..... B65H 19/1852 156/157
7,516,916 B2 4/2009 Titz et al.
2001/0035248 A1 * 11/2001 Sato ..... B65H 19/105 156/64

(Continued)

FOREIGN PATENT DOCUMENTS

DE 40 13 656 A1 11/1991
DE 10 2006 003 200 A1 8/2007

(Continued)

*Primary Examiner* — Sang K Kim
(74) *Attorney, Agent, or Firm* — McGlew and Tuttle, P.C.

(57) ABSTRACT

The invention concerns a splice arrangement with a first and second unwinding unit for unwinding a finite first or second material web and a connection apparatus. The connection apparatus comprises a guide, a first preparation apparatus and a second preparation apparatus. The connection apparatus also has a first and second connection apparatus for connecting the finite material webs to form an endless material web and a table unit, displaceable along the guide, for cooperation with the preparation apparatus and the connection apparatus. The splice arrangement further comprises an actuation apparatus for actuating the connection apparatus as well as the table unit.

12 Claims, 11 Drawing Sheets

(56) References Cited

U.S. PATENT DOCUMENTS

| | | | | |
|---|---|---|---|---|
| 2007/0075179 | A1* | 4/2007 | Mizutani | B65H 19/14<br>242/555.4 |
| 2007/0170300 | A1* | 7/2007 | Titz | B65H 19/102<br>242/552 |
| 2012/0211142 | A1 | 8/2012 | Casey et al. | |
| 2015/0291380 | A1 | 10/2015 | Fischer et al. | |

FOREIGN PATENT DOCUMENTS

| | | | |
|---|---|---|---|
| DE | 10 2014 207 050 | A1 | 10/2015 |
| EP | 1 770 038 | A2 | 4/2007 |

* cited by examiner

SPLICE ARRANGEMENT

CROSS-REFERENCE TO RELATED APPLICATIONS

This application claims the priority of German Patent Application Serial No. DE 10 2016 205 059.1 filed on Mar. 24, 2016, pursuant to 35 U.S.C. 119(a)-(d), the content of which is incorporated herein by reference in its entirety as if fully set forth herein.

FIELD OF THE INVENTION

The invention concerns a splice arrangement for splicing finite material webs into an endless material web, in particular for splicing finite paper webs for producing an endless corrugated board web in a corrugated board layer. The invention further concerns a method for splicing finite material webs into an endless material web.

BACKGROUND OF THE INVENTION

Known splice arrangements connect a finite material web nearing its end with a new finite material web, so that an endless material web is quasi created. This process is known in expert terminology as splice or splicing, and a corresponding arrangement as a splice or splicing arrangement. One disadvantage of the splice arrangements of prior art is often that the splicing of two finite material webs is still somewhat cumbersome, even with the same.

SUMMARY OF THE INVENTION

The invention is therefore based on the task of providing a splice arrangement that allows a particularly easy and functionally safe and economical splicing of finite material webs. In particular it should create a splice arrangement that is capable of splicing automatically or independently. A corresponding method should also be provided.

This task is solved in accordance with the invention by a splice arrangement for splicing material webs, with a first unwinding unit for unwinding a finite first material web from a first material roll, with a second unwinding unit for unwinding a finite second material web from a second material roll, with a connection device for connecting the finite first material web and the finite second material web with each other to form an endless material web, wherein the connection device comprises a guide, a first preparation apparatus, comprising a first transport roller, a second preparation apparatus, comprising a second transport roller, a first connection apparatus for connecting the finite material webs for form the endless material web, wherein the first connection apparatus comprises a first cutting unit for cross-cutting the finite first material web prior to connection with the finite second material web, a second connection apparatus for connecting the finite material webs to form the endless material web, wherein the second connection apparatus comprises a second cutting unit for cross-cutting the finite second material web prior to connection with the finite first material web, and a table unit displaceable along the guide for cooperating with the preparation apparatus and the connection apparatus, and with an actuation apparatus for actuating the connection apparatus and the table unit for splicing the finite material webs. Furthermore, this task is solved by a method for splicing material webs, comprising the steps: unwinding a finite first material web from a first material roll by means of a first unwinding unit, unwinding a finite second material web from a second material roll by means of a second unwinding unit, connecting the finite first material web and the finite second material web with each other to form an endless material web by means of a connection device, wherein the connection device comprises a guide, a first preparation apparatus, comprising a first transport roller, a second preparation apparatus, comprising a second transport roller, a first connection apparatus for connecting the finite material webs with the endless material web, wherein the first connection apparatus comprises a first cutting unit for cross-cutting the finite first material web prior to connection with the finite second material web, a second connection apparatus for connecting the finite material webs with the endless material web, wherein the second connection apparatus comprises a second cutting unit for cross-cutting the finite second material web prior to connection with the finite first material web, and a table unit, displaceable along the guide, for cooperation with the preparation apparatus and the connection apparatus, and actuating the connection apparatus and the table unit by means of an actuation apparatus for splicing the finite material webs.

The preparation apparatus are favourably displaceable independent from each other. It is of advantage if a first and/or second displacement drive of the first or second preparation apparatus is/are designed as an electric drive, pneumatic drive or hydraulic drive.

The actuation apparatus favourably actuates the connection device in such a way that a splicing of the two finite material webs with each other takes place automatically or is automated. In particular at least most of the steps required for splicing the two finite material webs are completed automatically or are automated.

The actuation apparatus is preferably of an electrical or electronic type. It is preferably designed as a controller.

It is of advantage if the actuation apparatus is in signal connection with the first preparation apparatus and the second preparation apparatus. The actuation apparatus is favourably in signal connection with the first connection apparatus and the second connection apparatus. It is expedient if the actuation apparatus is in signal connection with the table unit. It is expedient if the actuation apparatus is in signal connection with the first unwinding unit and the second unwinding unit. The signal connection can either be wireless or wired. Combinations are possible.

The table unit is favourably displaceable between the preparation apparatus along the guide. It is of advantage if the preparation apparatus can be displaced along the guide. The table unit preferably has a table unit drive.

The first connection apparatus favourably connects the web end of the finite first material web with the web start of the finite second material web. This connection is in particular realised through gluing.

It is of advantage if the second connection apparatus connects the web end of the finite second material web with the web start of the finite first material web. This connection is favourably realised through gluing.

It is of advantage if the splice arrangement also comprises a displaceable storage trolley for an uninterrupted or undelayed conveying of the endless material web.

It is of advantage if the finite first material web is a finite first paper web. The finite second material web is preferably a finite second paper web. A corrugated web can for example be produced from the endless material web. Alternatively this stays a smooth web.

The table unit and the first preparation apparatus are arranged adjacent to each other in their material inlet position so as to be displaceable relative to each other between a material web supply position and at least one holding position, spaced from each other, for holding the finite first material web on the first transport roller. It is of advantage if the table unit and the first preparation apparatus each stay in contact with each other in their material web holding position and form a first table preparation unit. It is expedient if the finite first material web is held in the relevant holding position through clamping or friction. The table units and the first preparation apparatus are favourably capable of taking up precisely two holding positions.

The design in which the table unit and the first preparation apparatus are capable, in a first holding position, of holding the finite first material web, but also allow a displacement of the same in relation to the table unit and/or the first preparation apparatus is extremely operator friendly. The finite first material web is held in the first holding position of the table unit and the first preparation apparatus, whilst a movement of the finite first material web in relation to the table unit and/or the first preparation apparatus is still possible, in particular when applying a corresponding force, in particular traction force, to the finite first material web.

The at least one first holding element of the table unit, which is effective in at least the first holding position for holding the finite first material web on the first transport roller, is for example designed as a spring element, in particular an elastically deformable spring element. It is of advantage if the at least one first holding element is metallic. The at least one holding element favourably presses the finite first material web against the first transport roller in the first holding position of the table unit and the first preparation apparatus, wherein a displacement of the finite first material web in relation to the at least one first holding element is possible, in particular upon application of a corresponding force, in particular a traction force, to the finite first material web. It is of advantage if the at least one first holding element is deformed by the first transport roller and/or the finite first material web in the first holding position. The table unit and the first preparation apparatus are favourably held together in their first holding position. This is for example realised with a corresponding drive of the table unit and/or the first preparation apparatus.

It is of advantage if the table unit and the first preparation apparatus are moved closer together or their total length is shorter in the second holding position compared with the first holding position in order to prevent a displacement of the finite first material web in relation to the table unit and/or the first preparation apparatus, wherein the table unit and the first preparation apparatus are preferably coupled with each other in the second holding position by means of a first coupling unit.

It is of advantage if the first coupling means is a mechanical coupling means. The first coupling means is preferably a first bolt unit. In particular the first coupling means comprises an actuatable first coupling bolt and a first coupling counterpart for interaction with the first coupling bolt in their coupled condition. It is expedient if the first coupling bolt is arranged on the table unit and the first coupling counterpart on the first preparation apparatus. The table unit and the first preparation apparatus are favourably held close together in the second holding position, so that a distance is preferably avoided between the same. It is of advantage if a second coupling means is designed according to the first coupling means.

It is of advantage if the at least one first fixing element of the table unit, which is effective in the second holding position for fixing the finite first material web in relation to the table unit and/or the first preparation apparatus, is for example formed from a friction material such as rubber, gum elastic or suchlike. It is of advantage if the at least one first fixing element presses the finite first material web against the first transport roller in the second holding position. It is expedient if the at least one first fixing element is deformed by the first transport roller and/or the finite first material web in the second holding position. A displacement of the first finite material web in relation to the at least one first fixing element is avoided in the second holding position, in particular also upon application of a corresponding force, in particular a traction force, onto the finite first material web.

Displacing the table unit and the first preparation apparatus, in their second holding position taking with them the fixed finite first material web, towards the first and/or second connection apparatus for splicing the finite first material web to the finite second material web is favourably realised with a corresponding drive of the table unit and/or the first preparation apparatus. The finite first material web is here held immovably in relation to the table unit and/or the first preparation apparatus.

In a preferred embodiment, 7 the table unit and the first preparation apparatus start or accelerate gently to tighten the finite first material web. A start acceleration function, in particular a ramp, is favourably envisaged for this.

The design in which the table unit and the first preparation apparatus take up the first holding position prior to reaching the first and/or second connection apparatus during at least one stop is functionally extremely safe. Damage to the finite first material web in particular can be very well avoided, which effectively prevents production interruptions in the end. The table unit and the first preparation apparatus favourably stop gently. A delay function, in particular a ramp, is preferably envisaged for this.

A splicing procedure such that the table unit and the first preparation apparatus take up the first holding position without stopping or slowing is extremely economical or fast.

The second preparation apparatus is favourably designed like the first preparation apparatus. It is of advantage if the second preparation apparatus is actuated like the first preparation apparatus in order to start splicing the finite second material web. The preparation apparatus are preferably mirrored or arranged symmetrically in relation to a vertically extending axis of symmetry. It is of advantage if the table unit is designed symmetrically, in particular in relation to a vertically extending axis of symmetry.

It is of advantage if the first unwinding unit comprises a first unwinding braking unit to generate a first unwinding braking force of between 10 N and 300 N upon displacing the table unit and the first preparation apparatus towards the first and/or second connection apparatus.

The respective prevailing first unwinding braking force of the splice arrangement is in particular dependent on the current diameter of the first material roll.

Preferred embodiments of the invention will now be described by way of examples with reference to the enclosed drawing.

DESCRIPTION OF THE PREFERRED EMBODIMENTS

Figure 1:
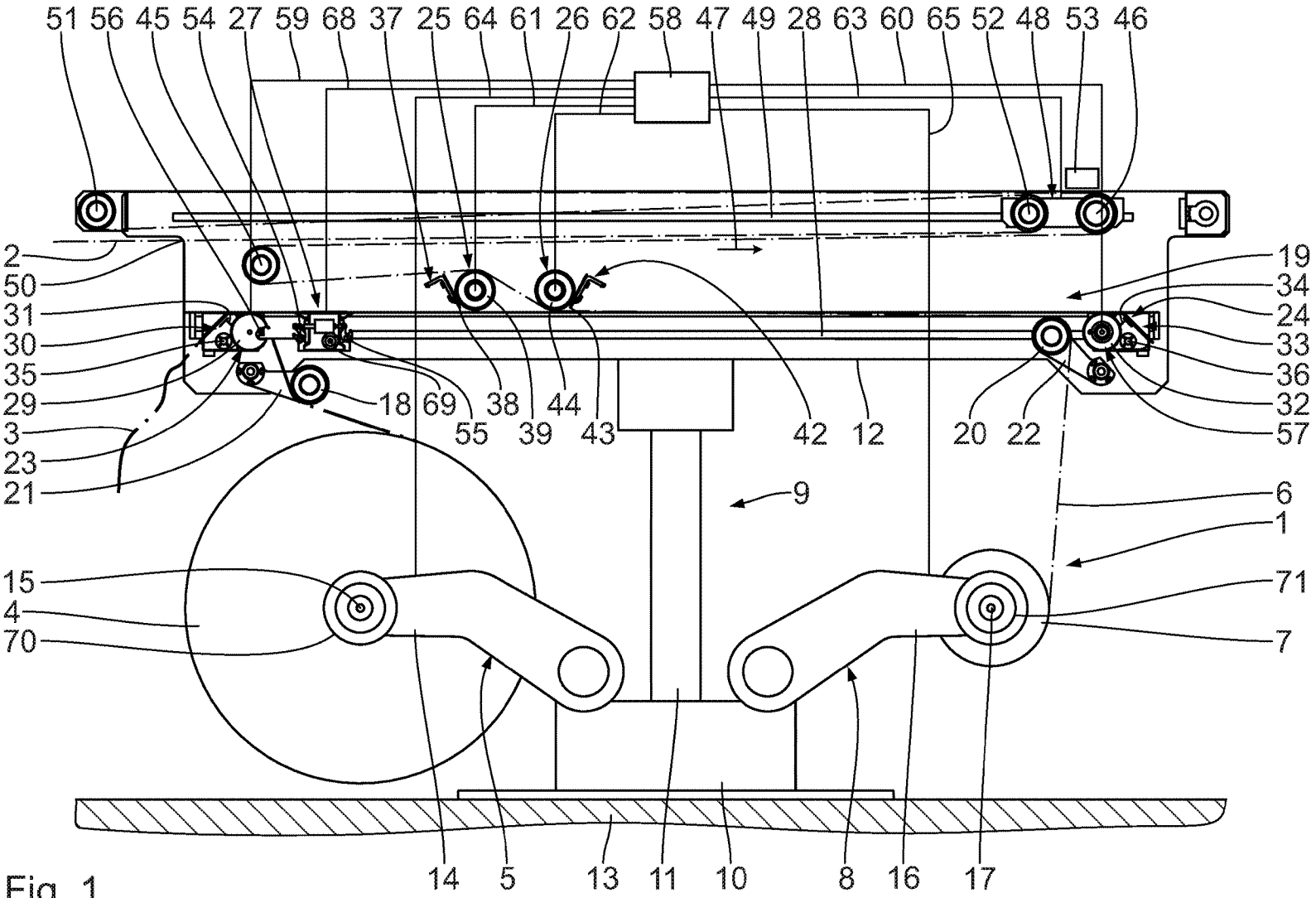
FIG. 1 to 4 schematic views of a splice arrangement according to the invention, showing successive splicing steps, FIG. 5 a schematic view of a first preparation apparatus and a table unit of the splice arrangement, located in their first holding position, FIG. 6 a view corresponding to FIG. 5, wherein the table unit and the first preparation apparatus are in their second holding position, FIG. 7 to 10 schematic views of the splice arrangement shown in FIG. 1 to 4, wherein speed functions of a first table preparation apparatus consisting of table unit and a first preparation apparatus are also shown, and FIG. 11 a schematic view of the splice arrangement shown in FIG. 1 to 4, wherein an alternative speed function of a first table preparation apparatus consisting of table unit and a first preparation apparatus is also shown.

With initial reference to FIG. 1 to 4 a corrugator (not shown in its entirety) comprises a known corrugated board production device (not shown) for producing a corrugated board web laminated on one side (not shown). Such a corrugator is generally also known as a single facer.

The corrugator comprises a grooving means with corrugated rollers for producing a corrugated web with corrugation from a material web. The corrugator comprises a glue application means for connecting the corrugated web with a smooth web, which applies glue to the peaks of the corrugation of the corrugated web. The corrugator has a pressing module for pressing the smooth web against the corrugated web equipped with glue, wherein the corrugated board web laminated on one side is created from the corrugated web and the smooth web.

The corrugator is preceded by a splice arrangement 1 for providing an endless material web 2 and a further splice arrangement (not shown) for providing a further endless material web (not shown). The corrugated web, forming part of the corrugated board web laminated on one side and also endless, can be produced from the endless material web 2. Alternatively the endless material web 2 forms the smooth web of the corrugated board web laminated on one side. The smooth web is also endless. The corrugated board web laminated on one side can be laminated with a further endless smooth web or a corrugated board web laminated on one side. The further smooth web can be formed by the endless material web 2.

As the two splice arrangements 1 are preferably identical, only the splice arrangement 1 illustrated in FIG. 1 to 4 will be described in detail hereafter. Its construction will be explained first.

The splice arrangement 1 comprises a first unwinding unit 5 for unwinding a finite first material web 3 from a first material roll 4, and a second unwinding unit 8 for unwinding a finite second material web 6 from a second material roll 7. The finite first material web 3 and the finite second material web 6 are firmly connected with each other by means of the splice arrangement 1 for providing the endless material web 2.

The splice arrangement 1 has a base frame 9 with a base frame plinth 10, a base frame stand 11 and a base frame support 12. The base frame plinth 10 is fitted to a floor or the ground 13. The base frame stand 11 is affixed to the top of the base frame plinth 10. The base frame stand 11 extends substantially vertically or perpendicular to the floor 13. The base frame support 12 is arranged in an end area of the base frame stand 11 opposite the base frame plinth 10 and extends substantially parallel to the floor 13, i.e. horizontal.

The first unwinding unit 5 and the second unwinding unit 8 extend from the base frame plinth 10. The unwinding units 5, 8 are pivotably mounted on the base frame plinth 10 and arranged relative to the base frame stand 11 opposite each other.

The first unwinding unit 5 comprises a first receiving part (not shown) for receiving the first material roll 4, which is guided into a central opening of the first material roll 4 and positioned to pivot around a first axis of rotation 15 between two first holding arms 14 of the first unwinding unit 5 extending parallel to each other.

The second unwinding unit 8 is designed like the first unwinding unit 5. It comprises a second receiving part (not shown) for receiving a second material roll 7, which is guided into a central opening of the second material roll 7 and positioned to pivot around a second axis of rotation 17 between two first second arms 16 of the second unwinding unit 8 extending parallel to each other. The axes of rotation 5, 17 extend horizontally and parallel to each other.

The finite first material web 3 is supplied to the splice arrangement 1 via a first supply roller 18 of a cutting and connection device 19, whilst the finite second material web 6 is supplied via a second supply roller 20 of the cutting and connection device 19. Each supply roller 18, 20 is rotatably mounted on a first or second support arm 21, 22, pivotably arranged on the base frame support 12 above the relevant material roll 4 or 7, for tensioning the relevant finite material web 3 or 6.

The cutting and connection device 19 serves for producing the endless material web 2 from the finite material webs 3, 6. It comprises a first preparation apparatus 23, a second preparation apparatus 24, a first connection apparatus 25, a second connection apparatus 26, a table unit 27 and a guide 28.

According to FIG. 1 the first preparation apparatus 23 is currently located on the base frame support 12 above the first material roll 4, whilst the second preparation apparatus 24 is currently located in the area between the second material roll 7 above the same on the base frame support 12 according to FIG. 1.

The guide 28 extends straight in/on the base frame support 12 and parallel to the floor 13 between the preparation apparatus 23, 34 arranged at the end in FIG. 1, wherein the preparation apparatus 23, 24 can be displaced along the guide 28.

The table unit 27 is also displaceable along the guide 28. It is arranged between the preparation apparatus 23, 24. The preparation apparatus 23, 24 and table unit 27 are displaceable along the guide 28 and relative to the connection apparatus 25, 26.

The connection apparatus 25, 26 are spaced apart from each other along the guide 28. They are arranged on the base frame support 12 above the guide 28.

The preparation apparatus 23, 24 are constructed identically and arranged symmetrically in relation to a vertically extending symmetrical plane.

The first preparation apparatus 23 comprises for a rotatably mounted first transport or holding roller 29 for supplying the finite first material web 3, and for example a first cross-cutter unit 30 with an actuatable first cutting blade 31 for cross-cutting the supplied finite first material web 3. The finite first material web 3 can thus be separated transverse to its longitudinal expansion or conveying direction with the first cross-cutter unit 30.

The first transport roller 29 of the first preparation apparatus 23 is for example equipped with an adhesive layer for holding and supplying the finite first material web 3 and is displaceable for transporting the finite first material web 3 to the first or second connection apparatus 25, 26 along the guide 28. A design of the first transport roller 29 without an adhesive layer is possible as an alternative. The first transport roller 29 is the for example non-adhesive or smooth on the outside.

The second preparation apparatus 24 comprises a rotatably mounted second transport or holding roller 32 for supplying the finite second material web 6, and for example a second cross-cutter unit 33 with an actuatable second cutting blade 34 for cross-cutting the supplied finite second material web 6. The finite second material web 6 can thus be separated transverse to its longitudinal expansion or conveying direction with the first cross-cutter unit 33.

The second transport roller 32 of the second preparation apparatus 24 is for example equipped with an adhesive layer for holding and supplying the finite second material web 6 and is displaceable for transporting the finite second material web 6 to the first or second connection apparatus 25, 26 along the guide 28. A design of the second transport roller 32 without an adhesive layer is possible as an alternative. The second transport roller 32 is the for example non-adhesive or smooth on the outside.

Each preparation apparatus 23, 24 comprises its own first or second displacement drive 35, 36 for its displacement along the guide 28.

The connection apparatus 25, 26 are designed identically and are arranged on the base frame support 12 in relation to vertically extending symmetry plane.

The first connection apparatus 25 comprises a first cutting unit 37 with an actuatable first cutting blade 38 for cutting the finite first material web 3 prior to connection with the finite second material web 6, and a first pressing roller 39 for connecting the finite material webs 3, 6 to form the endless material web 2. The first cutting unit 37 of the first connection apparatus 25 and the first pressing roller 39 are fitted directly adjacent to the guide 28 on the base frame support 12 in such a way that the transport rollers 29, 32 of the preparation apparatus 23, 24 and the table unit 27 can be routed along the guide 28 and past the first connection apparatus 25.

The second connection apparatus 26 comprises a second cutting unit 42 with an actuatable second cutting blade 43 for cutting the finite second material web 6 prior to connection with the finite first material web 3, and a second pressing roller 44 for connecting the finite material webs 3, 6 to form the endless material web 2. The second cutting unit 42 of the second connection apparatus 26 and the second pressing roller 44 are fitted directly adjacent to the guide 28 on the base frame support 12 in such a way that the transport rollers 29, 32 of the preparation apparatus 23, 24 and the table unit 27 can be routed along the guide 28 and past the second connection apparatus 26.

Figure 4:
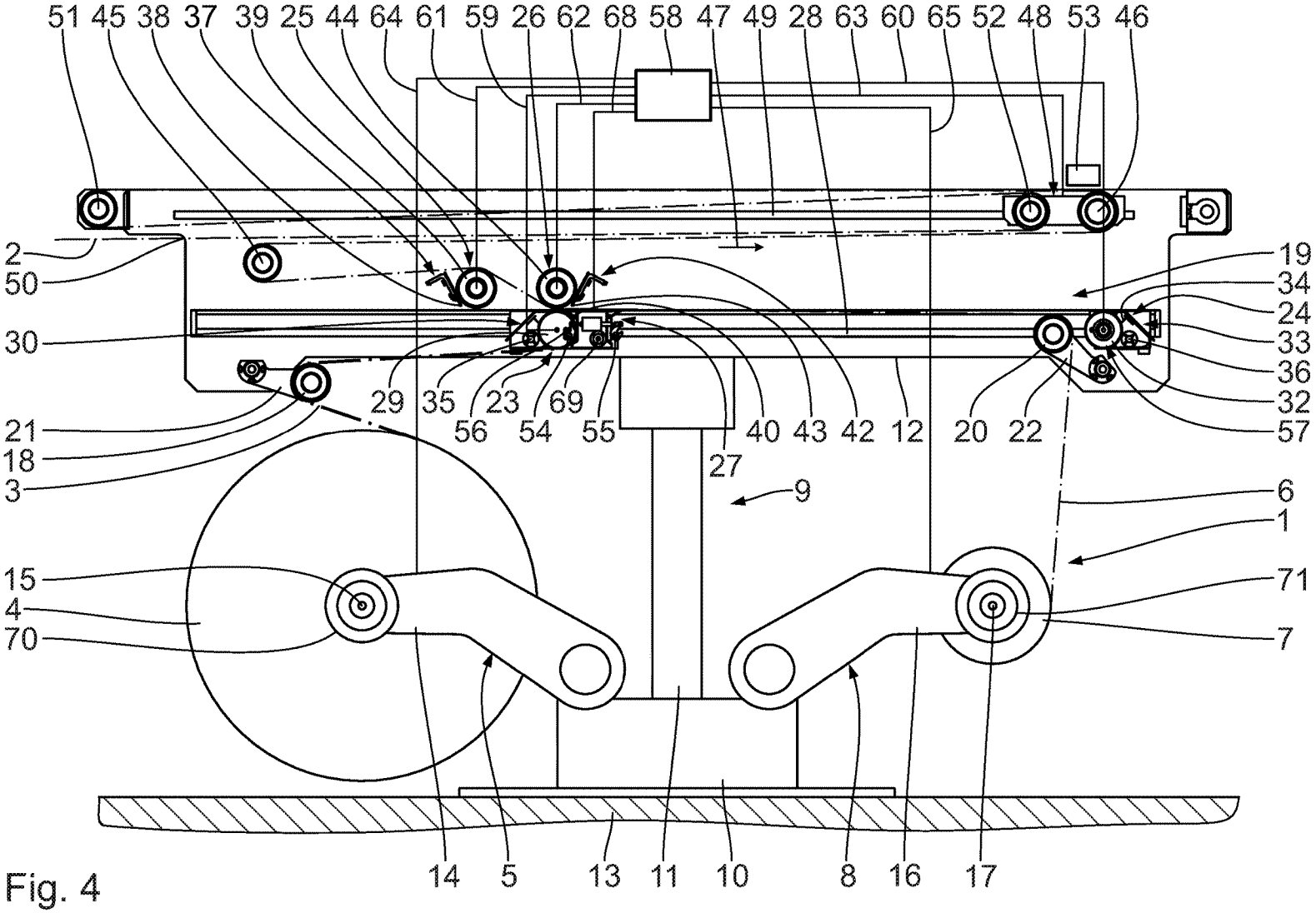

The second pressing roller 44 of the second connection apparatus 26 forms a first connection gap 40 with the first transport roller 29 of the first preparation apparatus 23 in the position shown in FIG. 4 with the same, for passing through the finite material webs 3, 6 to be connected and a first adhesive tape 41, which is adhesive on both sides and has been previously manually applied accordingly to a web start of the finite first material web 3 for connecting with the finite second material web 6 or the endless material web 2.

The first pressing roller 39 of the first connection apparatus 25 forms a second connection gap (not shown) with the second transport roller 32 of the second preparation apparatus 24 in the correspondingly displaced position with the same, for passing through the finite material webs 3, 6 to be connected and a second adhesive tape (not shown), which is adhesive on both sides and has been previously manually applied accordingly to a web start of the finite second material web 6 for connecting with the finite first material web 3 or the endless material web 2.

The table unit 27 acts together with the first preparation apparatus 23, the second preparation apparatus 24, the first connection apparatus 25 or the second connection apparatus 26 depending on its position and is displaceable along the guide 28, in particular also independently from the same.

A first deflection roller 45 is located downstream from the cutting and connection device 19 in transport direction 47 of the endless material web 2, which is mounted in the area of the first material roll 4 at the top of the base frame support 12. The endless material web 2 is guided around the first deflection roller 45.

The first deflection roller 45 is followed by a second deflection roller 46 in transport direction 47 of the endless material web 2, which is rotatably mounted on a storage trolley 48. The storage trolley 48 is arranged in the area of an upper end of the base frame support 12 facing away from the base frame stand 11 and is displaceable along a storage trolley guide 49 extending parallel to the floor 13 and above the guide 28. The storage trolley guide 49 prescribes a displacement path for the storage trolley 48 and extends substantially along the entire base frame support 12. The storage trolley 48 is here displaceable between a first end position and a second end position. It is displaceable in opposing displacement directions. In the first end position the storage trolley 48 is arranged adjacent to a material web outlet 50 of the splice arrangement 1, whilst the storage trolley 48 is spaced or removed from the material web outlet 50 in the second end position. The storage trolley 48 in the second end position in FIG. 1.

A third deflection roller 51 is rotatably mounted on the base frame support 12 in the area of the material web outlet 50 for deflecting the endless material web 2. The third deflection roller 51 is arranged downstream of the second deflection roller 46 in transport direction 47 of the endless material web 2.

A fourth deflection roller 52 is arranged downstream from the third deflection roller 51 in transport direction 47 of the endless material web 2, which is rotatably mounted on the storage trolley 48 between the second deflection roller 46 and the third deflection roller 51. The axes of rotation of deflection rollers 45, 46, 51, 52 extend horizontally and parallel to each other.

The splice arrangement 1 has a storage trolley displacement drive 53 for displacing the storage trolley 48 along the storage trolley guide 49.

Figure 5:
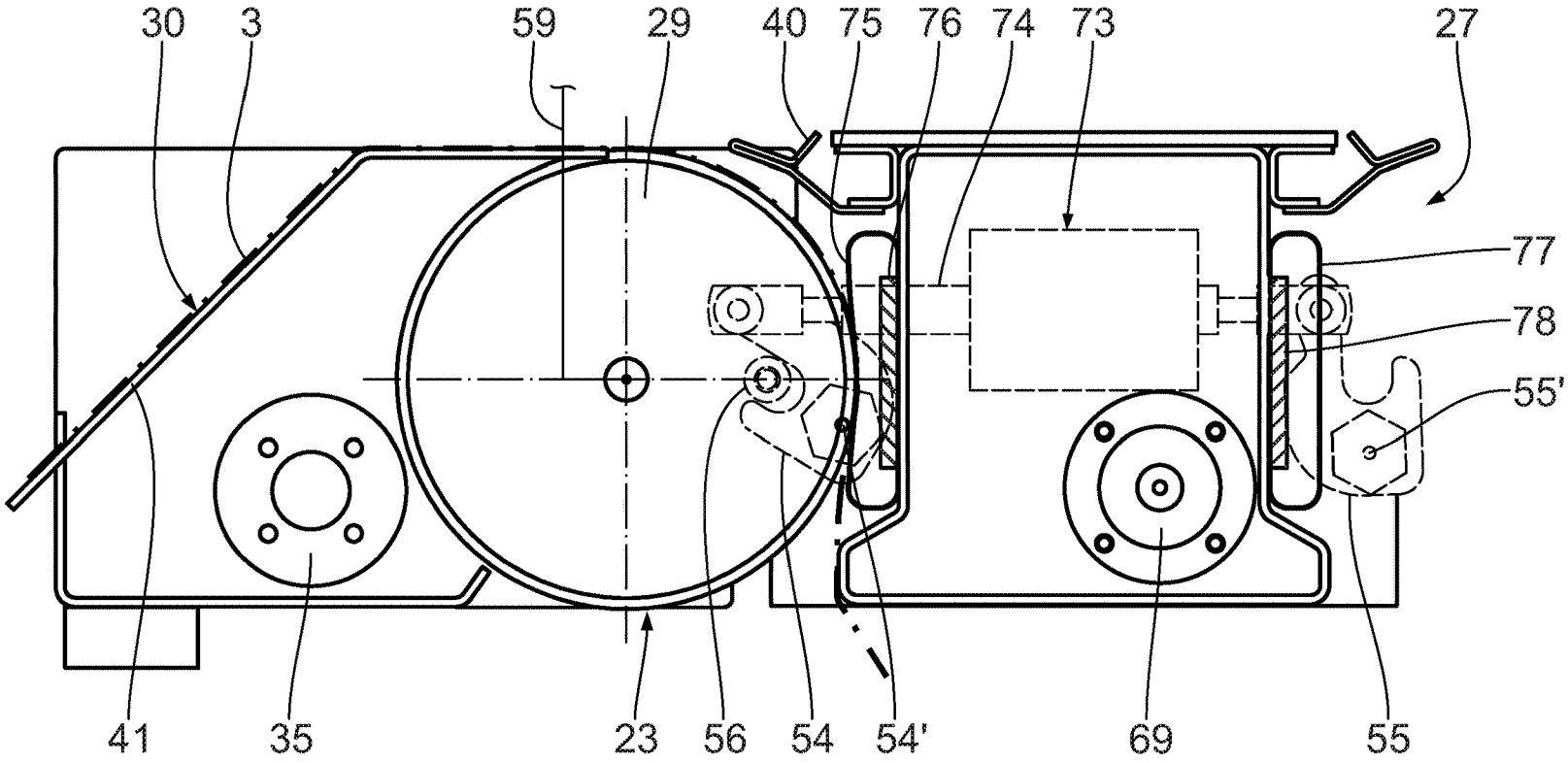
Figure 6:
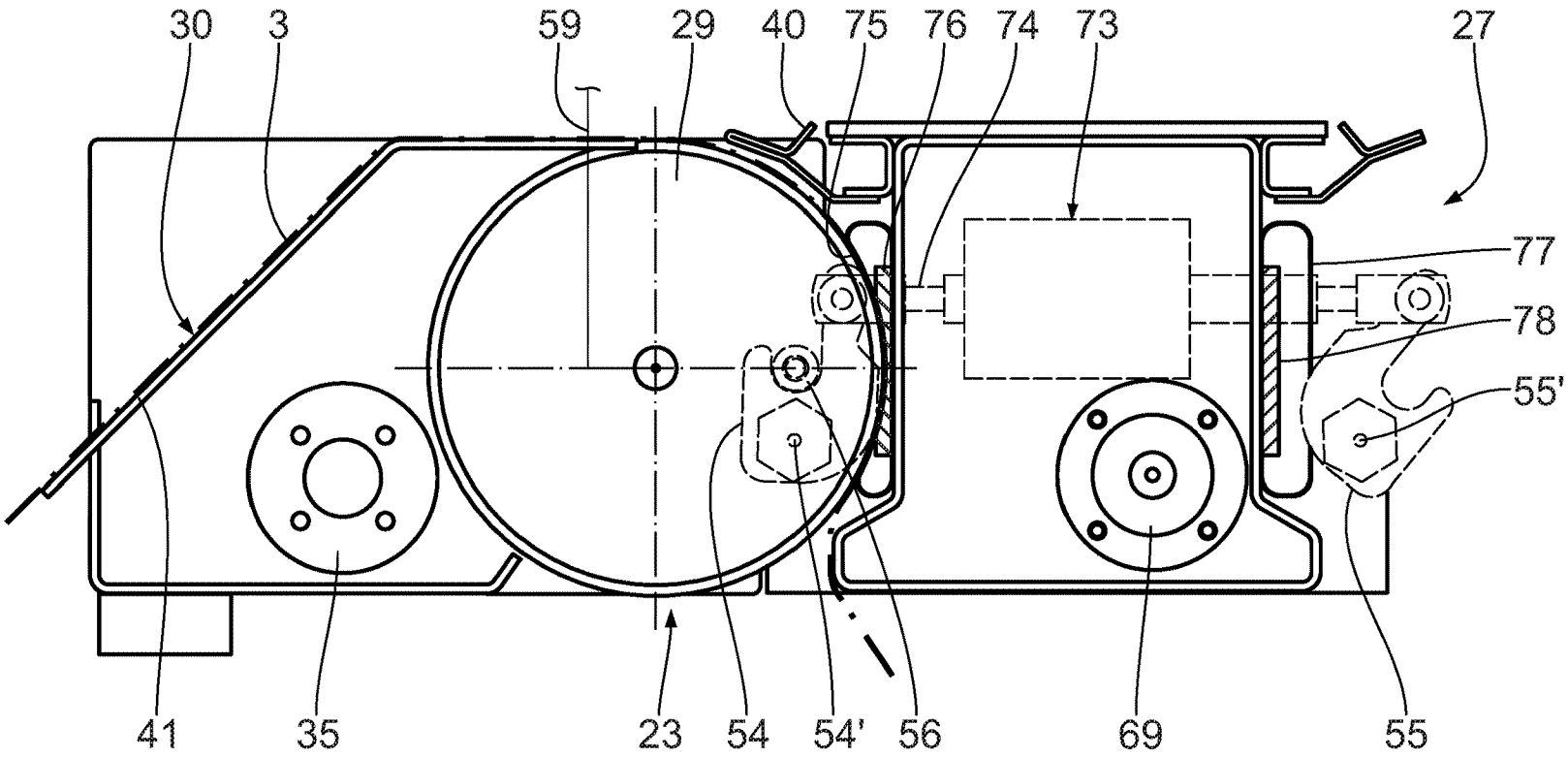

As is clear in particular from FIGS. 5 and 6, the table unit 27 bears a first coupling bolt 54 and a second coupling bolt 55. The two coupling bolts 54, 55 can be actuated, in particular displaced. The first coupling bolt 54 faces the first preparation apparatus 23, whilst the second coupling bolt 55 faces the second preparation apparatus 24.

The first preparation apparatus 23 bears a first coupling counterpart 56. The second preparation apparatus 24 bears a second coupling counterpart 57. The coupling counterparts 56, 57 are for example each formed by a pin, projection, wall area or suchlike.

The first coupling bolt 54 and the first coupling counterpart 56 together form a first coupling unit, so that the first preparation apparatus 23 and the table unit 27 can be disconnectably coupled with each other via the first coupling means. The second coupling bolt 55 and the second coupling counterpart 57 together form a second coupling unit, so that the second preparation apparatus 24 and the table unit 27 can be disconnectably coupled with each other via the second coupling means.

The first coupling bolt 54 and the second coupling bolt 55 are connected with an actuating means 73, which is capable of actuating the first coupling bolt 54 and/or the second coupling bolt 55. The actuating means 73 in particular has an axially displaceable actuating rod 74, which is in direct or indirect actuation connection with the first coupling bolt 54 and the second coupling bolt 55. A displacement of the actuating rod 74 therefore results in an actuation of the first coupling bolt 54 as well as the second actuating bolt 55. The second coupling bolt 54 is in particular pivotable around a first pivot axis 54', and the second coupling bolt 55 around a second pivot axis 55'. The coupling bolts 54, 55 are in particular coupled opposingly with each other, so that a movement of the first coupling bolt 54 into its coupling position will for example result in a movement of the second coupling bolt 55 into its release position.

The table unit 27 bears a first holding element 75, which faces the first preparation apparatus 23 and is deformable. It is preferably made from a metal material and made from a flat spring. The first holding element 75 delimits a first deformation chamber.

The table unit 27 also bears a first fixing element 76, which faces the preparation apparatus 23 and is deformable. The first fixing element 76 is preferably block- or plate-shaped and is for example made from a friction material. During use it favourably supplies a higher friction force than the first holding element 75 and is arranged adjacent to the first holding element 75.

The table unit 27 further bears a second holding element 77, which faces the second preparation apparatus 24 and is deformable. It is preferably made from a metal material and made from a flat spring. The second holding element 77 delimits a second deformation chamber.

The table unit 27 also bears a second fixing element 78, which faces the second preparation apparatus 24 and is deformable. The second fixing element 78 is preferably block- or plate-shaped and is for example made from a friction material. During use it favourably supplies a higher friction force than the second holding element 77 and is arranged adjacent to the second holding element 77.

The splice arrangement 1 also has an electronic controller 58. The controller 58 is in signal connection with the first preparation apparatus 23 via a first signal connection 59. The controller 58 is in signal connection with the second preparation apparatus 24 via a second signal connection 60. The controller 58 is in signal connection with the first connection apparatus 25 via a third signal connection 61. The controller 58 is in signal connection with the second connection apparatus 26 via a fourth signal connection 62. The controller 58 is in signal connection with the storage trolley 48 via a fifth signal connection 63. The controller 58 is in signal connection with the first unwinding unit 5 via a sixth signal connection 64. The controller 58 is in signal connection with the second unwinding unit 8 via a seventh signal connection 65. The controller 58 is in signal connection with the second unwinding unit 8 via an eight signal connection 68.

The functionality of the splice arrangement 1 will be described in more detail hereafter with reference to FIG. 1.

The finite second material web 6 is unwound from the second material roll 7 and conveyed in this way. It is supplied to the cutting and connection device 19 via the second supply roller 20, where the finite second material web 6 is deflected by about 90°. The finite second material web 6 is passed through between the pressing rollers 39, 44 located at a distance from each other and lies against their circumference in some areas.

After the cutting and connection device 19 the finite second material web 6 or the endless material web 2 is routed around the first deflection roller 45 and deflected by about 180°. The endless material web 2 is then routed to the second deflection roller 46, where it is again deflected by about 180°. After the second deflection roller 46 the endless material web 2 is routed around the third deflection roller 51, where it is again deflected by about 180°. The endless material web 2 is then routed around a fourth deflection roller 52, where it is once again deflected by about 180° and routed to the material web outlet 50. The endless material web 2 leaves the splice arrangement 1 at the material web outlet 50.

The storage trolley 48 is here located in its second end position. The two preparation apparatus 23, 24 are arranged at distances from the connection apparatus 25, 26. They are located in opposing end areas of the guide 28. The table unit 27 is arranged at a distance from preparation apparatus 23, 24 and the connection apparatus 25, 26.

The cutting and connection device 19 is in its inactive condition.

In this condition only the finite second material web 6 is routed through the cutting and connection device 19, whilst the finite first material web 3 is held in a waiting position by the cutting and connection device 19 or the first transport roller 29, so that the latter can be connected with the finite second material web 6 to form the endless first material web 2 when required. The first preparation apparatus 23 and the table unit 27 are initially arranged at a distance from each other for passing through the finite first material web 3, and then take up a material web supply position, so that the finite first material web 3 can be passed through between the same. The finite first material web 3 is then routed around the first transport roller 29 and aligned correspondingly for this. The table unit 27 is arrange at a distance from the connection apparatus 25, 26. The finite first material web 3 is deflected by the first supply roller 18.

Due to the steady unwinding of the finite second material web 6 the second material roll 7 will come to an end after a certain unwinding time, so that the finite first material web 3 must be connected with the finite second material web 6 via the cutting and connection device 19 for providing the endless material web 2.

Figure 2:
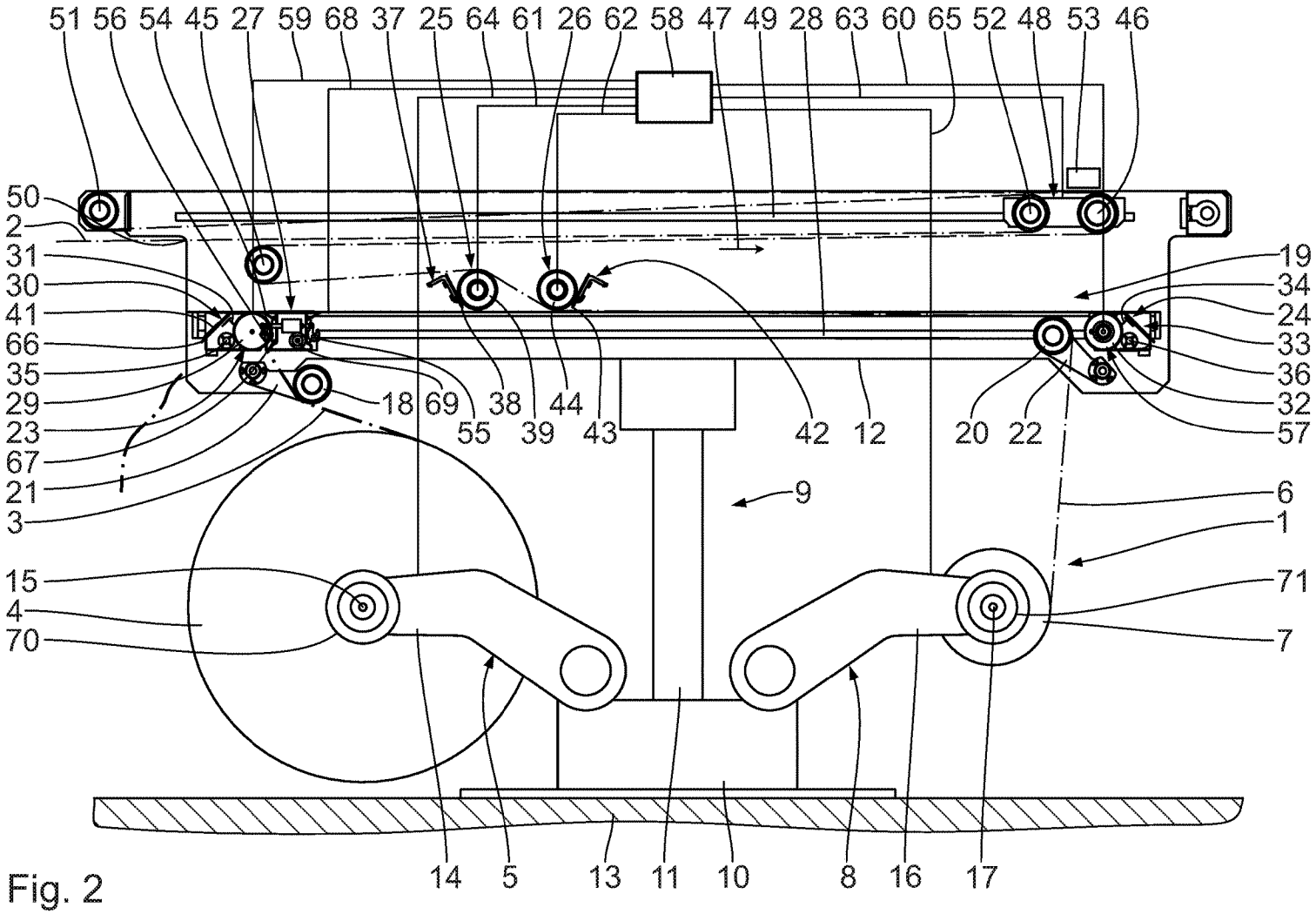

For this the table unit 27 is driven along the guide 28 to the first preparation apparatus 23 (FIG. 2). When the first preparation apparatus 23 and the table unit 27 touch each other, the threaded finite first material web 3 is held clamped between the first preparation apparatus 23 and the table unit 27. The finite first material web 3 in particular is held between the first transport roller 29 and the first holding element 75 under deformation of the same. The table unit 27 and the first preparation apparatus 23 take up their first holding position.

According to FIG. 2 the finite first material web 3 is then cut off by means of the first cutting blade 31, or in particular manually, in a transverse direction of the finite first material web 3. The first adhesive tape 41 is affixed at the newly created web start 66 of the finite first material web 3 by the first preparation apparatus 23, or in particular manually. The first adhesive tape 41 preferably extends across the entire width of the finite first material web 3. The controller 58 controls the first preparation apparatus 23 and/or the table unit 27 correspondingly via the first or eighth signal connection 59, 68.

The first preparation apparatus 23 and the table unit 27 are then coupled with each other via the first coupling unit, wherein the first material web 3 is held clamped between the first preparation apparatus 23 and the table unit 27. The first coupling bolt 54 in particular engages and locks the first coupling counterpart 56, wherein the first holding element 75 and the first fixing element 76 are deformed by the first transport roller 29 whilst fixing the finite first material web 3 on the first transport roller 29. The rotation of the first transport roller 29 is blocked. The first preparation apparatus 23 and the table unit 27 take up their second holding position in relation to each other.

The controller 58 controls the table unit 27, in particular the first coupling bolt 54 and the table unit drive 69 of the table unit 27, and/or the first preparation apparatus 23 correspondingly via the first or eighth signal connection 59, 68.

Figure 3:
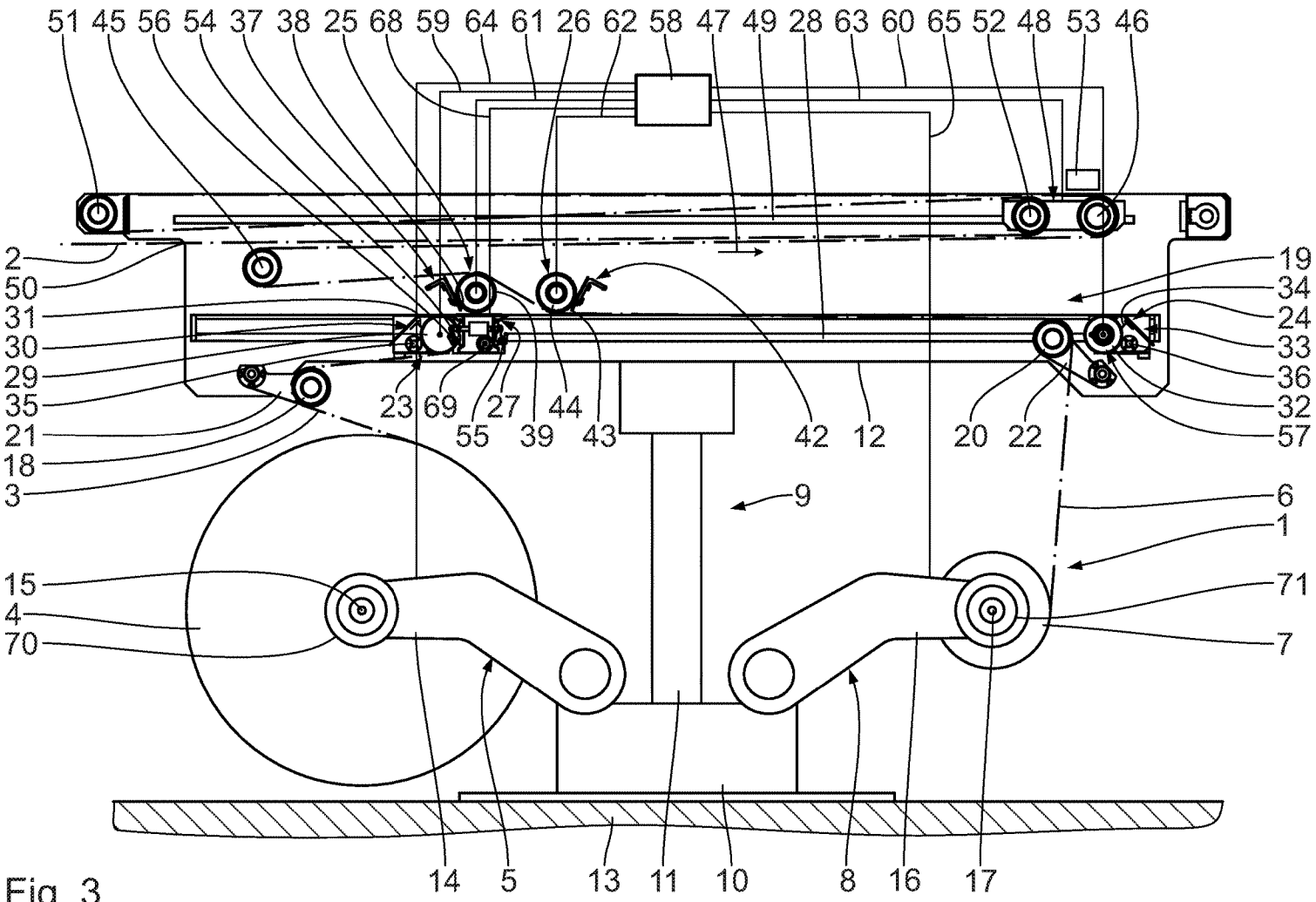

As shown in FIG. 3, the table unit 27 and the first preparation apparatus 23, which are coupled with each other and thus form a first table preparation unit, are then jointly displaced along the guide 28 in the direction of the second preparation apparatus 24 or the first preparation apparatus 25. Whilst displacing the first table preparation unit towards the first connection apparatus 25, its drive force is greater than the material web tension prevailing in the finite first material web 3 at that time. A first unwinding braking force is applied to the finite first material web 3 or the first material roll 4 via a first unwinding braking unit 70 of the first unwinding unit 5, which will depend on the diameter and lies between 10 N and 300 N. The first table preparation unit is accelerated gently when starting the first connection apparatus 25.

According to this embodiment the first table preparation unit is slowed gently by the first connection apparatus 25 and finally stopped gently adjacent to the first connection apparatus 25.

The first preparation apparatus 23 and the table unit 27 are then driven into the first holding position. The first transport roller 29 can then be rotated once more. The first material web 3 is held only by the first holding element 75 now.

The first transport roller 29 is pivoted in particular by displacing the first table preparation unit in such a way that the first adhesive tape 41 is brought into a splice position facing the table unit 27. The path required for this is known. The table unit 27 and the first preparation apparatus 25 receive corresponding control signals from the controller 58 via the signal lines 59 or 68 here.

The first preparation apparatus 23 and the table unit 27 then take up their second holding position again. The first preparation apparatus 23 and the table unit 27 are coupled with each other, wherein the first material web 3 is held clamped between the first preparation apparatus 23 and the table unit 27. The first coupling bolt 54 in particular engages and locks the first coupling counterpart 56, wherein the first holding element 75 and the first fixing element 76 are deformed by the first transport roller 29 whilst fixing the finite first material web 3 on the first transport roller 29. The rotation of the first transport roller 29 is blocked.

The first table preparation unit is then displaced towards the second connection apparatus 26 as shown in FIG. 4. When the second connection apparatus 26 is started, the first table preparation unit is accelerated gently.

The first table preparation unit is slowed gently by the second connection apparatus 26 and finally stopped gently adjacent to the second connection apparatus 26.

The endless second material web 6 is pressed against the adhesive end of the first adhesive tape 41, which is affixed to the web start 66 of the finite first material web 3 and is located on the pre-determined position on the first transport roller 29 of the first preparation apparatus 23, by means of the second pressing roller 44 of the second connection apparatus 26, wherein this second pressing roller 44 is routed to the first transport roller 29 of the first preparation apparatus 23 by a pneumatically operated pivot unit (not shown). This effects a connection of the endless material web 2 with the finite first material web 3. The supply of the finite second material web 6 to the endless material web 2 is stopped.

The first table preparation unit is displaced in the guide 28 for producing a cut edge in such a way that an edge of the second cutting blade 43 of the second cutting unit 42 of the second connection apparatus 26 displaced by a linear unit (not shown) can immerse into a recess in the table unit 27 envisaged for the second cutting blade 43 of the second cutting unit 42 of the second connection apparatus 26 across its entire width, for the complete separation of the finite second material web 6 from the endless material web 2.

After the cutting process for the complete separation of the endless material web 2 and the finite second material web 6 the second cutting blade 43 of the second cutting unit 42 of the second connection apparatus 26 is displaced into its starting position again, and the second pressing roller 44 of the second connection apparatus 26 into its starting position. In this way the endless material web 2, which is now connected with the finite first material web 3, is released.

The first preparation apparatus 23, via the first transport roller 29 of which the finite first material web 3 is now conveyed, remains arranged adjacent to the second connection apparatus 26. The controller 58 controls the first preparation apparatus 23, the second connection apparatus 26 and the table unit 27 correspondingly via the signal connections 59, 62 or 68.

Displacing the storage trolley 48 into the first end position loosens the loops formed by the endless material web 2, so that the endless material web 2 continues to leave the splice arrangement 1 without interruption or is conveyed without interruption.

The cutting and connection device 19 is then in its inactive condition. In This condition only the finite first material web 3 is passed through the cutting and connection device 19, whilst the second finite second material web 6 is held in a waiting position by the cutting and connection device 19, so that the same can be connected with the finite first material web 3 to form the endless first material web 2 if required.

If the timing of the first adhesion point and the positioning of the first table preparation unit are combined in the splice position, the process can be designed in a time optimised way.

Because of the known length of the finite first material web 3 the splice arrangement 1 recognises when the first material roll 4 comes to an end. Before this happens, the prepared finite second material web 6 is connected with the finite first material web 3. It happens at the same time as the previously explained change to the first material roll 4. We refer to this.

A second unwinding braking force, which lies between 10 N and 300 N depending on the diameter, can be applied to the finite second material web 6 or the second material roll 7 via a second unwinding braking unit 71 of the second unwinding unit 8 whilst displacing the second table preparation unit towards the second connection apparatus 26. The second unwinding unit 8 can be controlled accordingly by the controller 58 via the signal connection 65.

The splicing steps after threading the finite first material web 3 and clamping the same between the table unit 27 and the first preparation apparatus 23 will be explained in detail once more hereafter with reference to FIG. 7 to 10.

Figure 7:
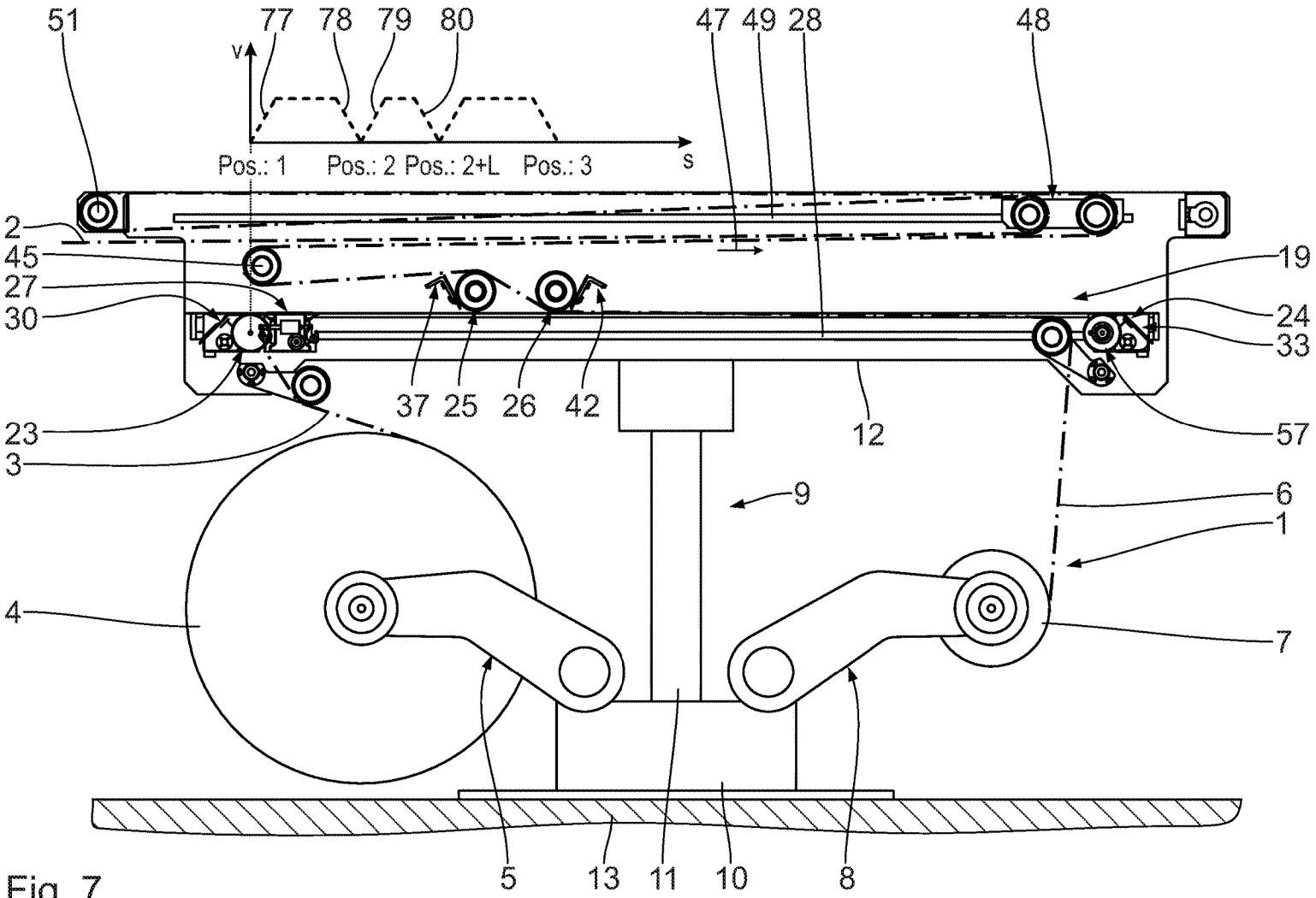

As shown in FIG. 7, the table unit 27 is arranged directly adjacent to the first preparation apparatus 23 for splicing the finite first material web 3 with the finite second material web 6.

The first preparation apparatus 23 and the table unit 27 are driven into their first holding position, so that the finite first material web 3 is held in a clamped, but still displaceable way. The first coupling unit is inactive. The first transport roller 29 is pivotable. The finite first material web 3 is pressed against the first transport roller 29 by the deformed first holding element 76.

The finite first material web 3 is then manually cut off in a transverse direction of the finite first material web 3 whilst the first coupling unit is inactive.

The first adhesive tape 41 is manually affixed to the newly created web start 66 of the finite first material web 3. The first adhesive tape 41 extends across the entire width of the finite first material web 3. It is favourably a double-sided adhesive tape 41.

The first preparation apparatus 23 and the table unit 27 are then coupled with each other via the first coupling unit, now active, so that the latter take up their second holding positions in relation to each other. The first coupling bolt 54 and the first coupling counterpart 56 are in an engaged and locked condition with each other. The finite first material web 3 is then fixed in relation to the first preparation apparatus 23 and the table unit 27. The first fixing element 76 is also deformed here. The first transport roller 29 is now also held non-rotatably.

The table unit 27 and the first preparation apparatus 23 are then displaced together in their second holding position along the guide 28 in the direction of the second preparation apparatus 24, or towards the first connection apparatus 25, which tensions the finite first material web 3. A displaced position is shown in FIG. 8.

Figure 8:
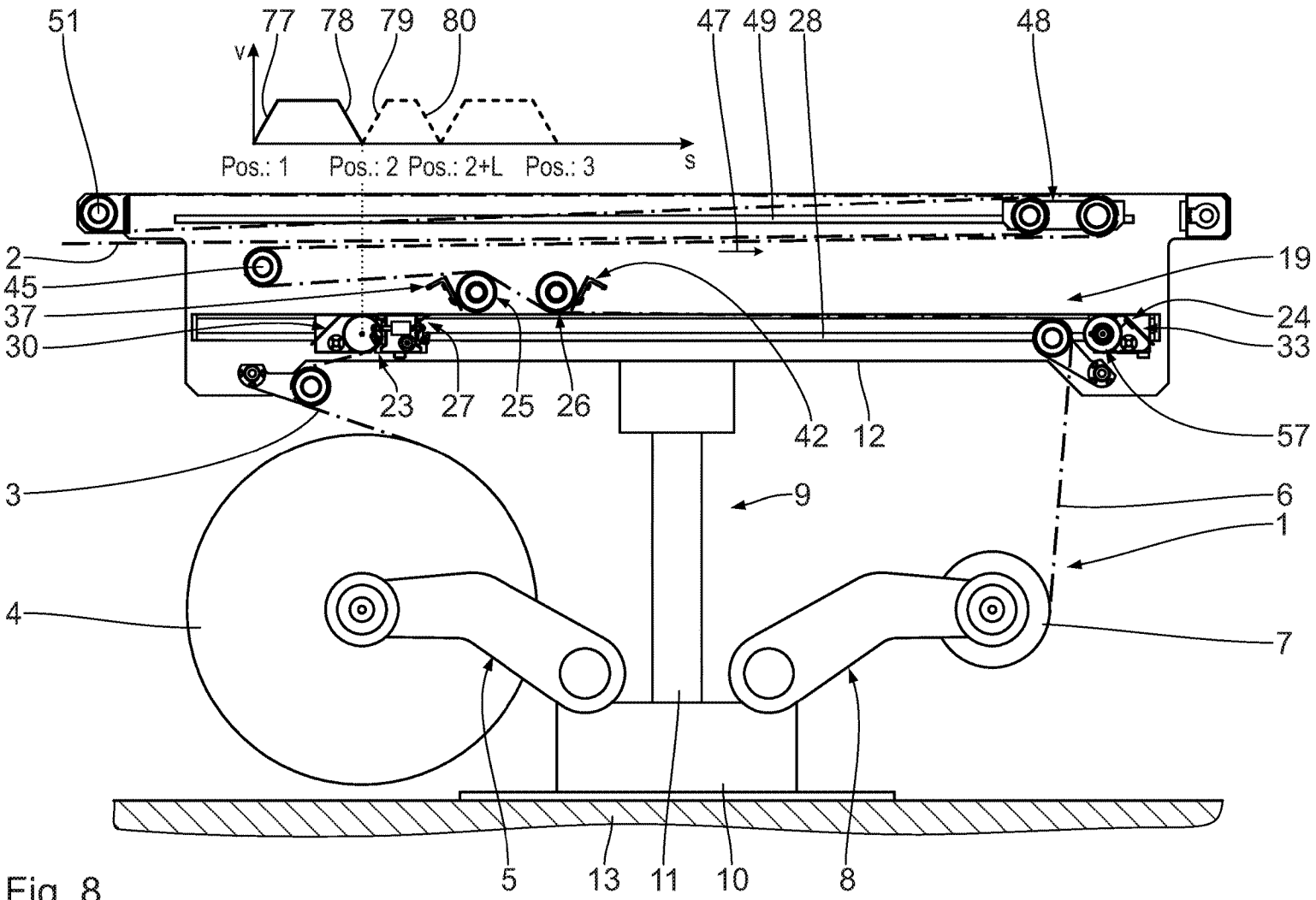

As the speed functions in FIGS. 7 and 8 show, the first table preparation unit is gently accelerated via a start acceleration ramp 77 until the same reaches a maximum speed. The maximum speed is maintained across a specific displacement path.

Whilst displacing the first table preparation unit towards the first connection apparatus 25, its drive force is greater than the material web tension prevailing in the finite first material web 3 at that time. A first unwinding braking force is applied to the finite first material web 3 or the first material roll 4 via a first unwinding braking unit 70 of the first unwinding unit 5, which will depend on the diameter and lies between 10 N and 300 N.

The first table preparation unit is slowed gently by the first connection apparatus 25 and finally stopped gently by means of a first ramp delay function 78. The table unit 27 and the first preparation apparatus 23 are then brought into their first holding position in a stopped condition of the table unit 27 and the first preparation apparatus 23, wherein the first coupling unit becomes ineffective. The first coupling bolt 54 and the first coupling counterpart 56 are in an unlocked condition. The finite first material web 3 is now held only by the first holding element 75 and the first fixing element 76 quasi becomes ineffective. The first transport roller 29 is thus released to rotate again.

Figure 9:
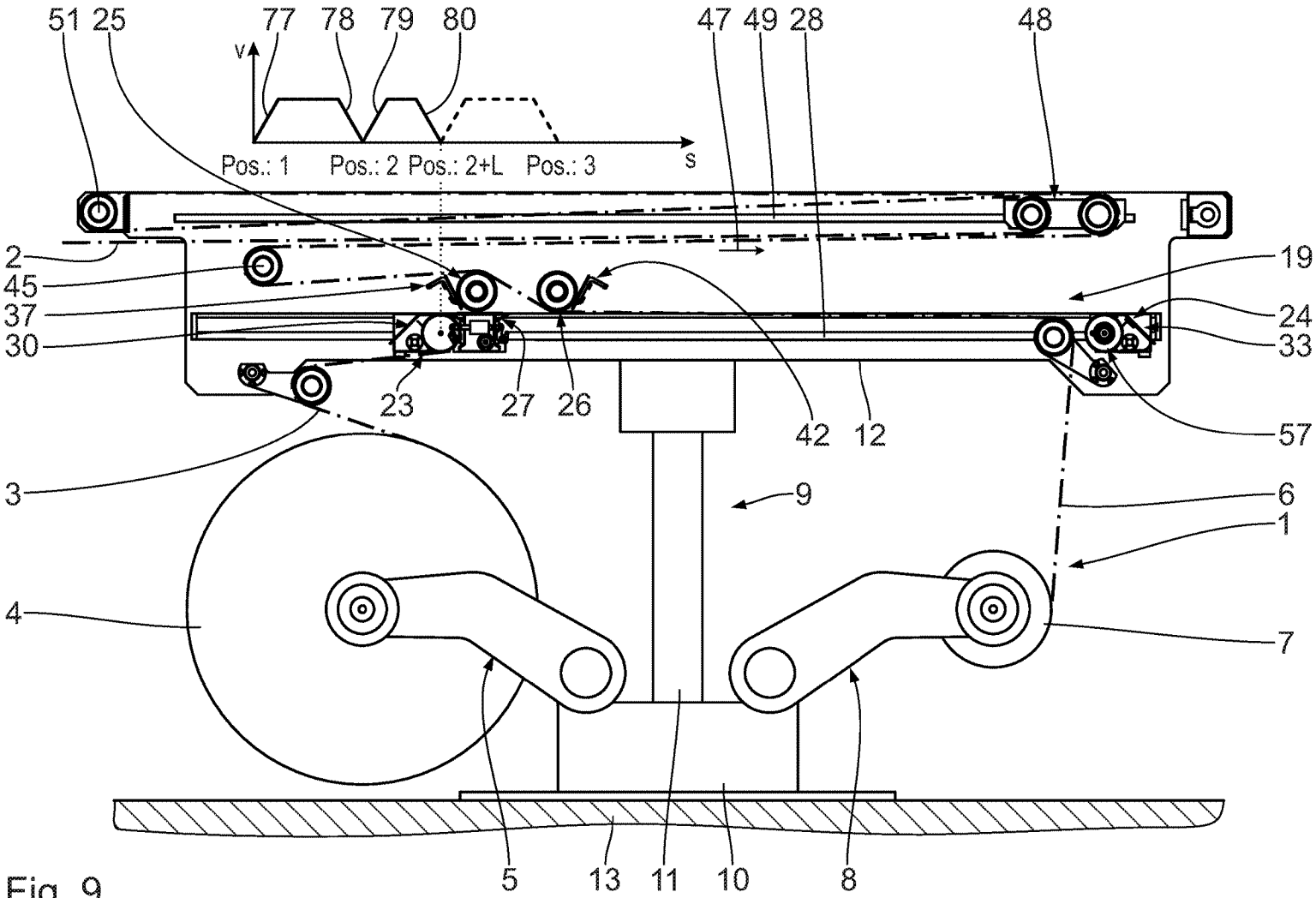

The table unit 27 and the first preparation apparatus 23 are then driven further towards the first connection apparatus 25 to their first holding position (FIG. 9). The table unit 27 and the first preparation apparatus 23 are gently accelerated by an interim acceleration ramp 79, wherein the finite first material web 3 is moved in relation to the table unit 27. Displacing the first preparation apparatus 23 and the table unit 27 in particular will reposition the first adhesive tape 41, so that it comes to lie in its splicing position and in relation to the first transport roller 29. The first adhesive tape 41 quasi faces the first fixing element 76 in the splicing position. A centring of the finite first material web 3 is also effected here. The table unit 27 and the first preparation apparatus 23 are then slowed by a delaying ramp 80. The table unit 27 and the first preparation apparatus 23 are brought into their second holding position. The first coupling bolt 54 and the first coupling counterpart 56 are in locking connection with each other. The finite first material web 3 is then fixed in relation to the first preparation apparatus 23 and the table unit 27. The first fixing element 76 is also deformed here. The first transport roller 29 is now held non-rotatably. The finite first material web 3 is evenly tensioned across its entire width.

Figure 10:
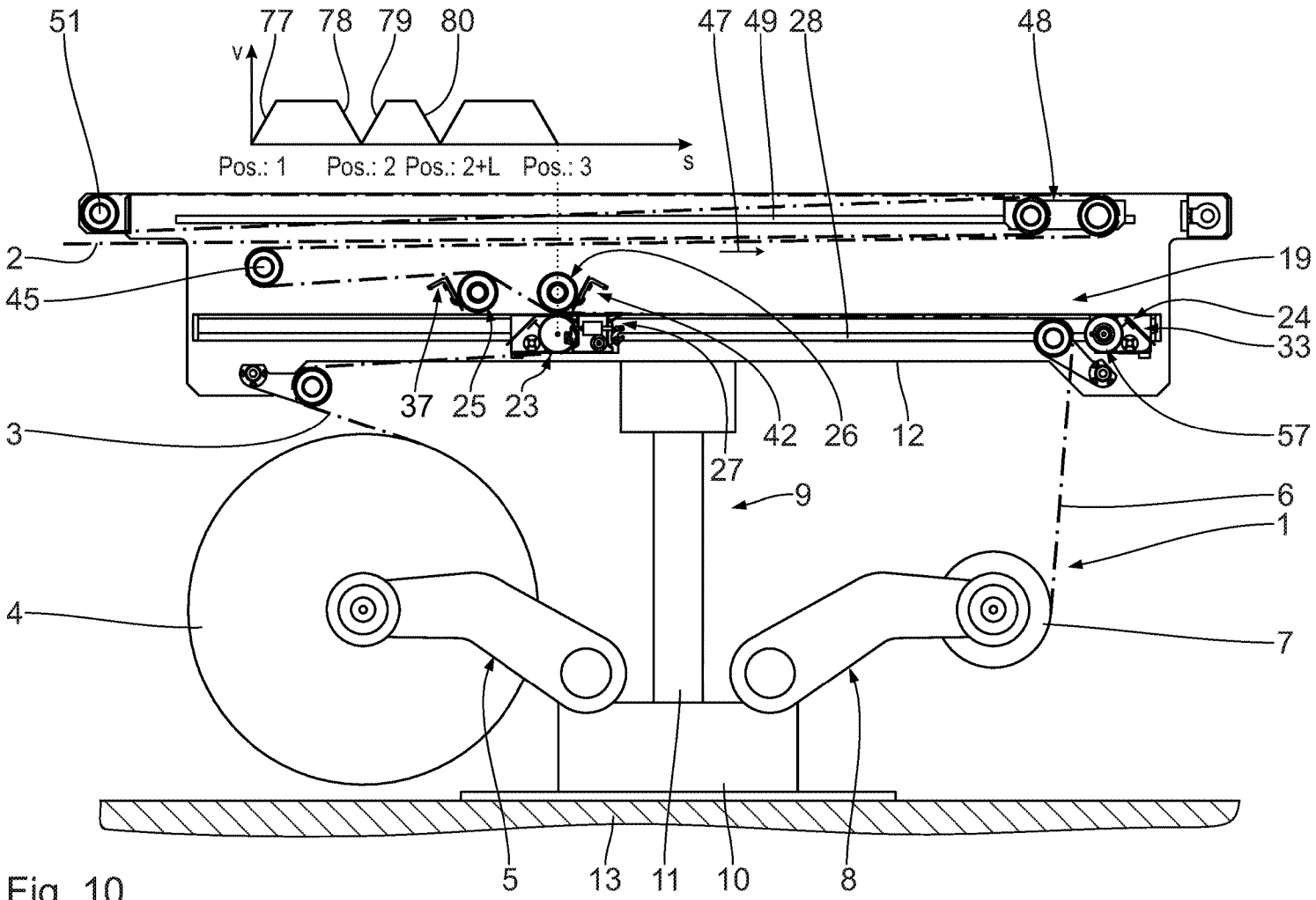

The table unit 27 and the first preparation apparatus 23 are then driven towards the second connection apparatus 26 in the second holding position (FIG. 10). A gentle acceleration and slowing is once again realised. The finite first material web 3 is spliced to the endless material web 2 at the second connection apparatus 26.

Figure 11:
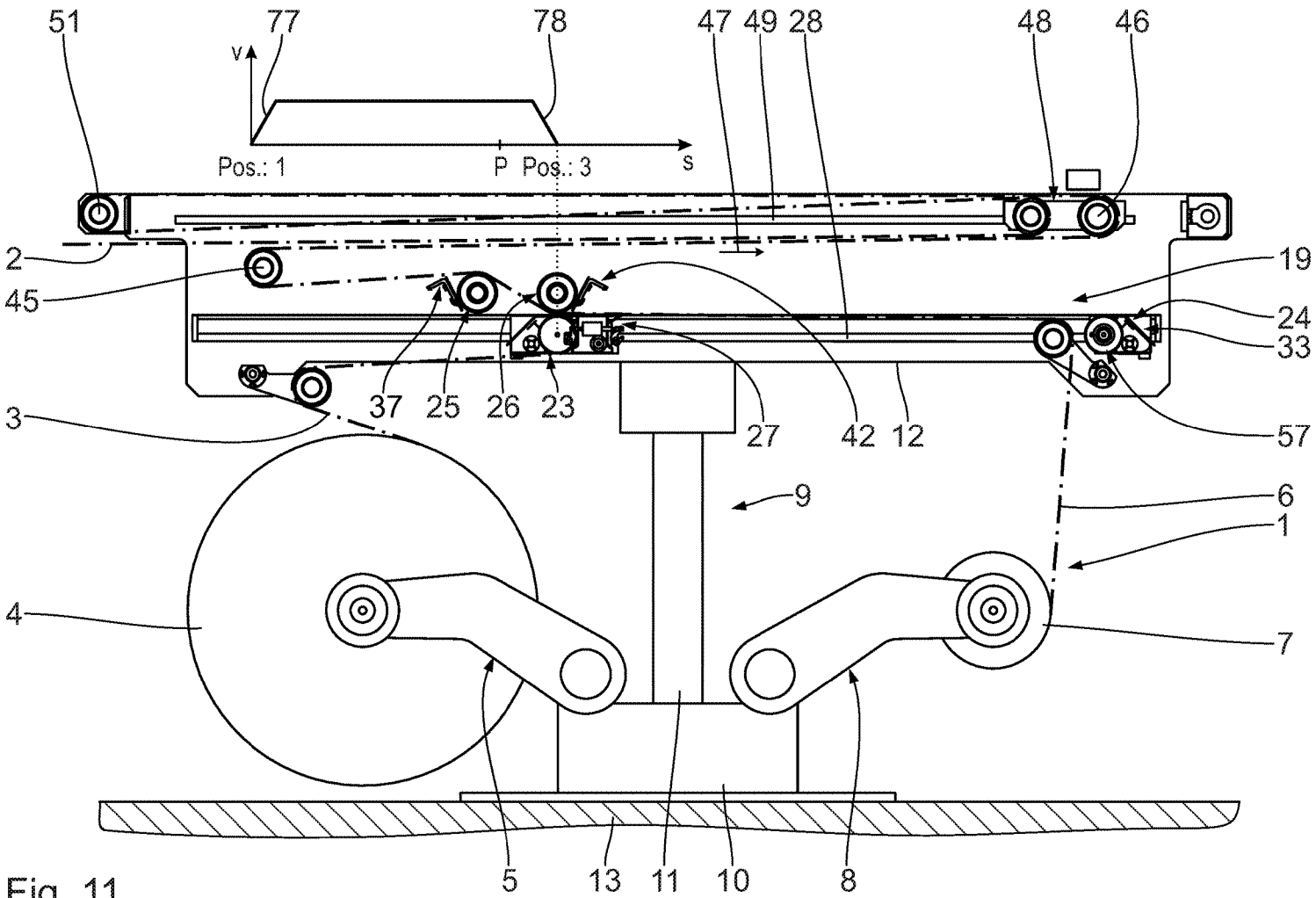

Contrary to FIG. 7 to 10 a starting of the second connection apparatus 26 take splice without an interim stop with the embodiment according to FIG. 11.

What is claimed is:

1. A splice arrangement for splicing material webs, the splice arrangement comprising:

a first unwinding unit for unwinding a finite first material web from a first material roll;

a second unwinding unit for unwinding a finite second material web from a second material roll;

a connection device for connecting the finite first material web and the finite second material web with each other to form an endless material web, wherein the connection device comprises a guide, a first preparation apparatus comprising a first transport roller, a second preparation apparatus comprising a second transport roller, a first connection apparatus for connecting the finite material webs for form the endless material web, a second connection apparatus for connecting the finite material webs to form the endless material web and a table unit displaceable along the guide for cooperating with the preparation apparatuses and the connection apparatuses, wherein the first connection apparatus comprises a first cutting unit for cross-cutting the finite first material web prior to connection with the finite second material web, wherein the second connection apparatus comprises a second cutting unit for cross-cutting the finite second material web prior to connection with the finite first material web, wherein the table unit and the first preparation apparatus, when positioned adjacent to each other, are displaceable relative to each other between a material web supply position and at least one holding position, spaced from each other, for holding the finite first material web on the first transport roller, the table unit and the first preparation apparatus being capable, in a first holding position, of holding the finite first material web, but also allow a displacement of the same in relation to at least one of the table unit and the first preparation apparatus, the table unit and the first preparation apparatus being capable, in a second holding position, of preventing a displacement of the finite first material web in relation to at least one of the table unit and the first preparation apparatus, the table unit and the first preparation apparatus being coupled with each other in the second holding position by a first coupling unit, the table unit and the first preparation apparatus taking up the first holding position prior to reaching at least one of the first connection apparatus and the second connection apparatus, wherein the table unit and the first preparation apparatus, in the first holding position, displace further in direction of at least one of the first connection apparatus and the second connection apparatus for bringing a first adhesive tape affixed to the finite first material web into a splicing position for connection with the finite second material web, the first transport roller pivoting automatically for bringing the first adhesive tape into the splicing position; and an actuation apparatus for actuating the connection apparatus and the table unit for splicing the finite material webs.

2. The splice arrangement according to claim 1, wherein the table unit comprises at least one holding element effective in at least the first holding position, for holding the finite first material web on the first transport roller.

3. The splice arrangement according to claim 1, wherein the first transport roller is rotatable in the first holding position of the table unit and the first preparation apparatus.

4. The splice arrangement according to claim 1, wherein the table unit comprises at least one first fixing element, effective in the second holding position, for fixing the finite first material web in relation to at least one of the table unit and the first preparation apparatus.

5. The splice arrangement according to claim 4, wherein a rotation of the first transport roller is blocked in the second holding position of the table unit and the first preparation apparatus.

6. The splice arrangement according to claim 1, wherein the table unit and the first preparation apparatus, in the second holding position taking with them the fixed finite first material web, displace towards at least one of the group comprising the first and the second connection apparatus for splicing the finite first material web to the finite second material web.

7. The splice arrangement according to claim 6, wherein the table unit and the first preparation apparatus gently accelerate to tighten the finite first material web.

8. The splice arrangement according to claim 1, wherein the table unit and the first preparation apparatus take up the first holding position prior to reaching at least one of the first connection apparatus and the second connection apparatus during at least one stop.

9. The splice arrangement according to claim 1, wherein the table unit and the first preparation apparatus take up the first holding position without one of stopping and slowing.

10. The splice arrangement according to claim 1, wherein a drive force of a drive of at least one of the table unit and the first preparation apparatus for unwinding the finite first material web is greater than a material web tension of the finite first material web upon displacing the same towards at least one of the first connection apparatus and the second connection apparatus.

11. A method for splicing material webs, the method comprising the steps:

unwinding a finite first material web from a first material roll by a first unwinding unit, unwinding a finite second material web from a second material roll by a second unwinding unit, connecting the finite first material web and the finite second material web with each other to form an endless material web by means of a connection device, wherein the connection device comprises a guide, a first preparation apparatus comprising a first transport roller, a second preparation apparatus comprising a second transport roller, a first connection apparatus for connecting the finite material webs with the endless material web, a second connection apparatus for connecting the finite material webs with the endless material web and a table unit, displaceable along the guide, for cooperation with the preparation apparatuses and the connection apparatuses, wherein the first connection apparatus comprises a first cutting unit for cross-cutting the finite first material web prior to connection with the finite second material web, wherein the second connection apparatus comprises a second cutting unit for cross-cutting the finite second material web prior to connection with the finite first material web, wherein the table unit and the first preparation apparatus, when positioned adjacent to each other, are displaceable relative to each other between a material web supply position and at least one holding position, spaced from each other, for holding the finite first material web on the first transport roller, the table unit and the first preparation apparatus being capable, in a first holding position, of holding the finite first material web, but also allow a displacement of the same in relation to at least one of the table unit and the first preparation apparatus, the table unit and the first preparation apparatus being capable, in a second holding position, of preventing a displacement of the finite first material web in relation to at least one of the table unit and the first preparation apparatus, the table unit and the first preparation apparatus being coupled with each other in the second holding position by a first coupling unit, the table unit and the first preparation apparatus taking up the first holding position prior to reaching at least one of the first connection apparatus and the second connection apparatus, wherein the table unit and the first preparation apparatus, in the first holding position, displace further in direction of at least one of the first connection apparatus and the second connection apparatus for bringing a first adhesive tape affixed to the finite first material web into a splicing position for connection with the finite second material web, the first transport roller pivoting automatically for bringing the first adhesive tape into the splicing position; and actuating the connection apparatuses and the table unit by an actuation apparatus for splicing the finite material webs.

12. A splice arrangement for splicing material webs, the splice arrangement comprising:

a first unwinding unit for unwinding a finite first material web from a first material roll;

a second unwinding unit for unwinding a finite second material web from a second material roll;

a connection device for connecting the finite first material web and the finite second material web with each other to form an endless material web, wherein the connection device comprises a guide, a first preparation apparatus comprising a first transport roller, a second preparation apparatus comprising a second transport roller, a first connection apparatus for connecting the finite material webs for form the endless material web, a second connection apparatus for connecting the finite material webs to form the endless material web and a table unit displaceable along the guide for cooperating with the first preparation apparatus, the second preparation apparatus, the first connection apparatus and the second connection apparatus, wherein the first connection apparatus comprises a first cutting unit for cross-cutting the finite first material web prior to connection with the finite second material web, wherein the second connection apparatus comprises a second cutting unit for cross-cutting the finite second material web prior to connection with the finite first material web, wherein the table unit and the first preparation apparatus, when positioned adjacent to each other, are displaceable relative to each other between a material web supply position and at least one holding position, spaced from each other, for holding the finite first material web on the first transport roller, the table unit and the first preparation apparatus being capable, in a second holding position, of preventing a displacement of the finite first material web in relation to at least one of the table unit and the first preparation apparatus, the table unit and the first preparation apparatus being coupled with each other in the second holding position via a first coupling unit; and an actuation apparatus for actuating one or more of the first connection apparatus, the second connection apparatus and the table unit for splicing the finite material webs.

* * * * *